US008726978B2

(12) United States Patent
Takada et al.

(10) Patent No.: US 8,726,978 B2
(45) **Date of Patent: *May 20, 2014**

(54) HEAT EXCHANGER ELEMENT AND HEAT EXCHANGER

(75) Inventors: Masaru Takada, Tokyo (JP); Hidemoto Arai, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 657 days.

This patent is subject to a terminal disclaimer.

(21) Appl. No.: 12/593,122

(22) PCT Filed: May 2, 2007

(86) PCT No.: PCT/JP2007/059387

§ 371 (c)(1),
(2), (4) Date: Sep. 25, 2009

(87) PCT Pub. No.: WO2008/139560

PCT Pub. Date: Nov. 20, 2008

(65) Prior Publication Data

US 2010/0139901 A1 Jun. 10, 2010

(51) Int. Cl.
*F28F 3/00* (2006.01)
*F28F 13/18* (2006.01)

(52) U.S. Cl.
USPC ..... 165/166; 165/133

(58) Field of Classification Search
USPC ..... 165/166, 133
See application file for complete search history.

(56) References Cited

U.S. PATENT DOCUMENTS

| | | | | |
|---|---|---|---|---|
| 4,588,025 | A * | 5/1986 | Imai et al. | 165/133 |
| 6,536,514 | B1 | 3/2003 | Sugiyama et al. | |
| 7,299,862 | B2 | 11/2007 | Takada et al. | |
| 8,316,542 | B2 * | 11/2012 | Imai et al. | 29/890.03 |
| 8,607,851 | B2 * | 12/2013 | Takada et al. | 165/166 |
| 2003/0094269 | A1 * | 5/2003 | Arai et al. | 165/166 |

(Continued)

FOREIGN PATENT DOCUMENTS

| | | |
|---|---|---|
| CA | 2 580 575 A1 | 2/2007 |
| EP | 2 071 267 A1 | 6/2009 |

(Continued)

OTHER PUBLICATIONS

Office Action from Japanese Patent Office issued in corresponding Japanese Patent Application No. 2009-513901 dated Sep. 6, 2011, with an English translation thereof.

(Continued)

*Primary Examiner* — Brandon M Rosati
(74) *Attorney, Agent, or Firm* — Buchanan Ingersoll & Rooney PC

(57) ABSTRACT

A heat exchanger element includes partition members that include first gas passages that are passages for first gas and second gas passages that are passages for second gas and that are provided above the first gas passages, the partition members operative to partition the first gas passages and the second gas passages; spacing members that form the first gas passages and the second gas passages and that maintain a gap between the partition members; and an adhesive that adheres the partition member and the spacing member with each other. At least one of the partition member and the spacing member is made of a liquid absorbing material, and the adhesive is a water solvent adhesive in which water-soluble flame retardant is impregnated.

7 Claims, 6 Drawing Sheets

(56) References Cited

U.S. PATENT DOCUMENTS

| | | | | |
|---|---|---|---|---|
| 2006/0090650 | A1 | 5/2006 | Yamakawa et al. | |
| 2007/0095513 | A1 | 5/2007 | Arai et al. | |
| 2008/0105418 | A1* | 5/2008 | Takada et al. | 165/166 |
| 2010/0089558 | A1* | 4/2010 | Takada et al. | 165/167 |
| 2011/0108256 | A1 | 5/2011 | Takada et al. | |
| 2011/0146961 | A1 | 6/2011 | Imai et al. | |

FOREIGN PATENT DOCUMENTS

| | | | |
|---|---|---|---|
| EP | 2 138 792 | A1 | 12/2009 |
| GB | 2 417 315 | A | 2/2006 |
| JP | 62-026498 | A | 2/1987 |
| JP | 6-109395 | A | 4/1994 |
| JP | 10-153398 | A | 6/1998 |
| JP | 10-212691 | A | 8/1998 |
| JP | 2001-27489 | A | 1/2001 |
| JP | 2003-148892 | A | 5/2003 |
| JP | 2003-251133 | A | 9/2003 |
| JP | 3501075 | B2 | 2/2004 |
| JP | 2005-24207 | A | 1/2005 |
| JP | 2005-121264 | A | 5/2005 |
| JP | 2006-150323 | A | 6/2006 |
| JP | 3791726 | B2 | 6/2006 |
| WO | WO 02/099193 | A1 | 12/2002 |
| WO | 2008041327 | A1 | 4/2008 |
| WO | 2008129669 | A1 | 10/2008 |

OTHER PUBLICATIONS

International Search Report for PCT/JP2007/059387 completed Jul. 30, 2007.

Written Opinion for PCT/JP2007/059387 completed Jul. 30, 2007.

English translation of Decision of a Patent Grant issued by the Japanese Patent Office on Jun. 5, 2012.

Extended European Search Report dated Jan. 16, 2014, issued by the European Patent Office in the corresponding European Application No. 07742822.5. (7 pages).

* cited by examiner

HEAT EXCHANGER ELEMENT AND HEAT EXCHANGER

TECHNICAL FIELD

The present invention relates to heat exchanger elements and heat exchangers, and, more particularly to a heat exchanger element and a heat exchanger for use in an air conditioner or a ventilation and that is operative to exchange sensible heat alone, or both latent heat and sensible heat, between two kinds of air having different temperatures and humidities.

BACKGROUND ART

Heat exchanger elements are known in the art. There has been know a heat exchanger element having multilayered first layer airflow passages, multilayered second layer airflow passages arranged perpendicularly to the first layer airflow passages, partition members operative as partitions between the first and second airflow passages, spacing members that form the first and second airflow passages and that maintain gaps between the partition members, and adhesives that adhere the partition members and the spacing members to each other. The heat exchanger element exchanges latent heat and sensible heat between first air flowing through the first layer airflow passages and second air flowing through the second layer airflow passages using the partition members as media.

The partition member is provided between two air currents intersecting with each other at right angles, and it is operative to exchange sensible heat and latent heat. Therefore, sensible heat and latent heat exchange efficiency as an entire heat exchanger element is largely affected by heat conductivity of the partition member and moisture permeability in the case of a total heat exchanger. The spacing member maintains a gap between the partition members, and secures passages through which two air currents intersecting with each other at right angles flow. The spacing member is mostly made from paper made of cellulose fiber (pulp) because of the low cost thereof. Depending on desired functions, the spacing member can be made from resin, or a material in which pulp and resin are mixed.

In the total heat exchanger element, absorbent (moisture permeability agent) is usually added to the partition member to impart moisture permeability to the partition member. Alkali metal or alkaline earth metallic salt such as lithium chloride and calcium chloride, which is a water-soluble absorbent, is mainly used as the absorbent (for example, see Patent Document 1). Powder absorbent such as silica gel or strong acid or strong base ion-exchange resin is mainly used as water-insoluble absorbent (for example, see Patent Documents 2, 3, and 4).

A water solvent adhesive is mainly used as an adhesive for adhering the partition member and the spacing member to each other. The reason being that if an organic solvent adhesive is used, remaining organic solvent itself is diffused, smell is generated by the diffusion, and this is not preferable as a total heat exchanger element for an air conditioner. In addition, a complicated and expensive auxiliary facility, such as an apparatus for collecting organic solvent, is required for a manufacturing facility of the heat exchanger element, and this increases costs.

Patent Document 1: Japanese Patent Application Laid-open No. H6-109395

Patent Document 2: Japanese Patent Application Laid-open No. H10-153398

Patent Document 3: Japanese Patent Application Laid-open No. 2003-251133

Patent Document 4: International Publication No. 02/099193 Pamphlet

Patent Document 5: Japanese Patent No. 3791726

Patent Document 6: Japanese Patent No. 3501075

Patent Document 7: Japanese Patent Application Laid-open No. H10-212691

DISCLOSURE OF INVENTION

Problem to be Solved by the Invention

It is necessary that a heat exchanger element has a flame retardancy function for securing product safety in case of fire. For this reason, a material to which flame retardant is added or a special material having a flame retardancy function is used for the partition member and the spacing member (for example, see Patent Documents 5, 6, and 7). That is, additional processing step for providing the members with flame retardancy is required in a stage of processing a material prior to production of heat exchanger elements. The flame retardancy mentioned in the present invention is intended to be kinds of flame retardancy prescribed in JIS A1322 "Testing Method for Incombustibility of Thin Materials for Buildings" and correspond to any one of "fireproof class 1, class 2, and class 3".

The present invention has been achieved in view of the above circumstances. An object of the present invention is to obtain a heat exchanger element that can be easily manufactured and has a flame retardancy function, a method of manufacturing the heat exchanger element, and a heat exchanger.

Means for Solving Problem

To solve the above problems and to achieve the above objects, according to an aspect of the present invention, there is provided a heat exchanger element including partition members that include first gas passages that are passages for first gas and second gas passages that are passages for second gas and that are provided above the first gas passages, the partition members operative to partition the first gas passages and the second gas passages; spacing members that form the first gas passages and the second gas passages and that maintain a gap between the partition members; and an adhesive that adheres the partition member and the spacing member with each other. At least one of the partition member and the spacing member is made of a liquid absorbing material. The adhesive is a water solvent adhesive in which water-soluble flame retardant is impregnated.

Effect of the Invention

According to the heat exchanger element of the present invention, at least one of the partition member and the spacing member has water absorbability, and the partition member and the spacing member are adhered to each other by a water solvent adhesive in which water-soluble flame retardant is impregnated. Therefore, when the water solvent in the water solvent adhesive dries, the water-soluble flame retardant permeates liquid-absorbing portions of the partition member and the spacing member and the flame retardant is diffused into the liquid-absorbing portions, and the entire heat exchanger element is provided with the flame retardancy function.

A material of the heat exchanger element is provided with the flame retardancy function when the heat exchanger element is manufactured (at the time of adhesion).

There is an advantage that total manufacturing time of the heat exchanger element itself is reduced, energy required for manufacturing the element is reduced, cost thereof is reduced, and it is easy to manufacture the element and the element is inexpensive. If a material has liquid absorbability, it can be used as a material of the heat exchanger element irrespective of the degree of flame retardancy, and flexibility in selecting the material is enhanced.

In the case of a conventional heat exchanger element manufactured such that water-soluble flame retardant is impregnated into materials of the partition member and the spacing member before the heat exchanger element is processed, a loss that is discarded together with materials at the time of adjusting size during processing step of the heat exchanger element is generated, and the flame retardancy of the heat exchanger element is reduced. However, in the case of the heat exchanger element of the present invention, because it is possible to contrive such that an adhesive is not applied to a portion of a material that is to be discarded, it is possible to obtain a heat exchanger element having the same or higher level of flame retardancy using the same amount of flame retardant. At the same time, because chemical solution to be discarded is reduced, environmental load caused by production is also reduced, and an environmentally-friendly heat exchanger element can be obtained.

Figure 1:
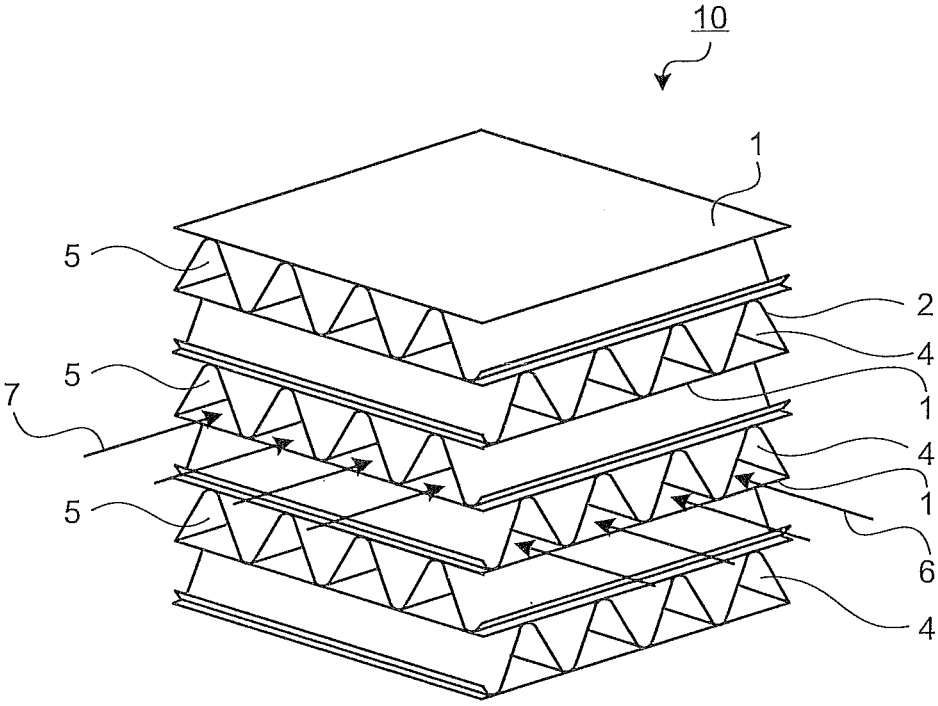
FIG. 1 is a perspective view of one example of a configuration of a heat exchanger element according to a first embodiment of the present invention.

| EXPLANATIONS OF LETTERS OR NUMERALS | |
|---|---|
| 1 | partition member |
| 2 | spacing member |

-continued

| EXPLANATIONS OF LETTERS OR NUMERALS | |
|---|---|
| 3 | adhesive |
| 4 | first layer airflow passages |
| 5 | second layer airflow passages |
| 6 | first air |
| 7 | second air |
| 10, 20 | heat exchanger element |
| 31, 32 | corrugator |
| 33 | press roll |
| 34 | pasting roll |
| 100 | heat exchanger |

BEST MODE(S) FOR CARRYING OUT THE INVENTION

Exemplary embodiments of a heat exchanger element and a heat exchanger according to the present invention will be explained below in detail with reference to the accompanying drawings. The present invention is not limited to the following descriptions, i.e., various modifications can be made appropriately without departing from the scope and spirits of the invention. In the drawings explained below, scales between members are different from the actual scales in some cases to facilitate the understanding. Scales between the drawings are also different in some cases.

First Embodiment

Configuration of Heat Exchanger Element

FIG. 1 is a perspective view of one example of a configuration of a heat exchanger element 10 according to a first embodiment of the present invention. As shown in FIG. 1, the heat exchanger element 10 according to the first embodiment includes multilayered first layer airflow passages 4, and multilayered second layer airflow passages 5 arranged perpendicularly to the first layer airflow passages 4. The first layer airflow passage 4 and the second layer airflow passage 5 include sheet-like partition members 1 that are operative as partitions between the first and second airflow passages 4 and 5, corrugated sheet spacing members 2 that form the first and second airflow passages and that maintain gaps between the partition members, and adhesives 3 that adhere the partition members 1 and the spacing members 2 to each other. The heat exchanger element 10 having such a configuration exchanges both latent heat and sensible heat between first air 6 flowing through the first layer airflow passages 4 and second air 7 flowing through the second layer airflow passages 5 using the partition members 1 as media.

Figure 2:
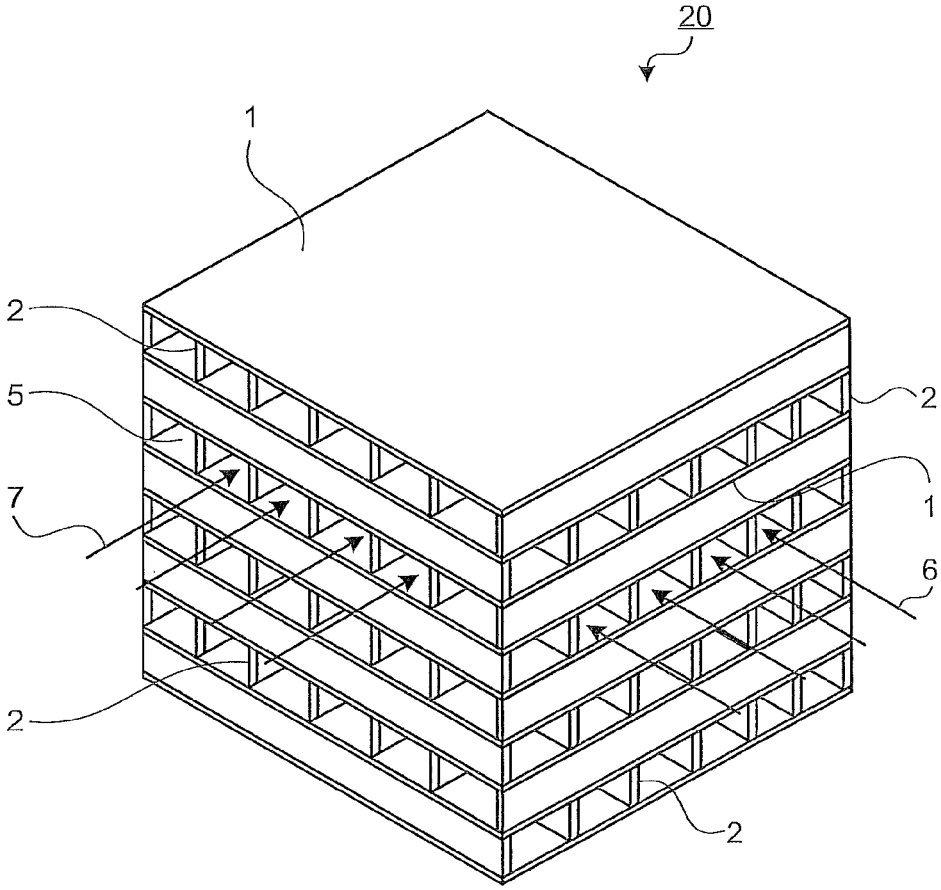
FIG. 2 is a perspective view of another heat exchanger element according to the first embodiment of the present invention.

The spacing members 2 are corrugated sheets as shown in FIG. 1. However, the spacing members 2 can be formed in a different manner. As an example of another configuration of the heat exchanger element, the spacing members 2 can be sheets folded into a rectangular wave form or a triangular wave form or can be a plurality of plate pieces (ribs) if a predetermined gap can be kept between the partition members 1. FIG. 2 depicts a heat exchanger element 20 as a variant of the heat exchanger element according to the first embodiment. The heat exchanger element 20 includes a plurality of plate pieces as the spacing members 2.

Figure 3:
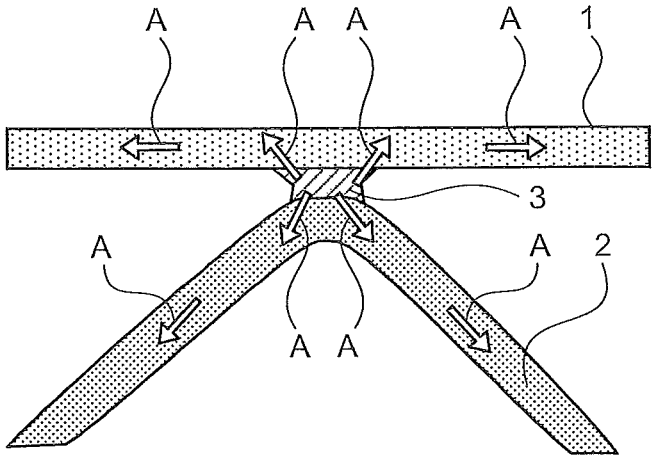
FIG. 3 is an enlarged sectional view of an adhered portion where a partition member and a spacing member are adhered in the heat exchanger element according to the first embodiment of the present invention.

FIG. 3 is an enlarged sectional view of an adhered portion where the partition member 1 and the spacing member 2 are adhered to each other in the heat exchanger element according to the first embodiment shown in FIG. 1. The partition member 1 is made of a liquid absorbing material having liquid absorbability. In this specification, the term "liquid absorbability" means a capability to absorb moisture together with dissolved matters (water-soluble flame retardant in this specification) dissolved in the moisture. Liquid absorbability is differentiated from a capability to selectively absorb only moisture (water absorbability). Examples of principles of the liquid absorbability are water absorption caused by capillary action of a porous material such as pulp, unwoven cloth, and woven cloth, and absorption of aqueous solution together with solution dissolved therein like high water absorbability resin such as acrylic acid sodium copolymer.

The spacing member 2 is also made of a absorbing material in the same manner as the partition member 1. With respect to the basis weight (meaning weight per unit area), in order to provide the partition member 1 and the spacing member 2 with flame retardancy of a certain level using flame retardant, it is necessary to add flame retardant of a certain ratio or higher to a base material (of the partition member 1 and the spacing member 2). The term "basis weight" is frequently used for expressing thickness of a paper sheet, and its unit is generally $g/m^2$. The basis weight is also called "fiber density" in the field of unwoven cloth. In order to avoid increase of the amount of flame retardant more than necessary, it is preferable to use a thin material as thin as possible, as long as the quality of the heat exchanger element is secured.

As materials and configurations of the partition member 1 and the spacing member 2, those that can widely diffuse absorbed aqueous solution into the member are preferable. It is preferable that the entire surface of the member can absorb aqueous solution. However, even if a sheet-like material is formed by bonding a liquid non-absorbing material and a liquid absorbing material to each other and one of the surface of the sheet-like material has the liquid absorbability, the liquid absorbing material surface can absorb liquid and aqueous solution can be diffused within the liquid absorbing material, the sheet-like material can be used as the liquid absorbing material as a whole although it takes time until aqueous solution is diffused.

If the partition member 1 and the spacing member 2 have liquid absorbability, these members can previously be provided with a flame retardancy function and it is of course possible to use a flame-retardant paper sheet to which flame retardant is previously applied, and a material having flame retardancy. In the case of the total heat exchanger element, a member to which absorbent is added can be used to enhance the latent heat exchanging efficiency. Examples of the absorbent are alkali metallic salt, alkaline earth metallic salt, alginic acid and salt thereof such as lithium chloride and calcium chloride, polysaccharide such as carrageenan and chitosan, urea, hydrophilic zeolite, silica gel, and ion-exchange resin.

If the partition member 1 and the spacing member 2 to which other chemical is previously added are used for other purposes, it is necessary to choose such a chemical that does not chemically react with flame retardant that is added to the adhesive 3 at a later stage. If there is a possibility of a chemical reaction between the two, because there is a possibility that reaction occurs and flame retardancy of the chemical is lost, it is necessary to change either the flame retardant added to the adhesive 3 or chemical added to the partition member 1 and the spacing member 2 to chemical solution that does not chemically react.

A water solvent adhesive having water as main solvent is used as the adhesive 3 that adheres the partition member 1 and the spacing member 2 to each other. If the adhesive 3 contains water as solvent and flame retardant can be dissolved in the adhesive, the adhesive 3 can be used in the present invention. Therefore, it is possible to use, as the adhesive, an emulsion-dispersed adhesive in which adhering resin is mixed as emulsion in water (vinyl acetate resin-based resin, ethylene-vinyl acetate copolymer (EVA)-based resin, vinyl acetate-acrylic ester copolymer-based resin, acryl-vinyl acetate-based resin, polyurethane-based resin depending on kinds of resin for adhesive), and water-soluble high polymer resin such as polyvinyl alcohol (PVA), polyvinyl pyrrolidone (PVP), and polyacrylic acid.

As another criterion for selecting an adhesive, when flame retardancy or adhering aptitude with respect to a material to be adhered is considered, an adhesive is selected, in some cases, based on the fire spread, an amount of fumes generated at the combustion, and component of gas after combustion depending on corresponding standard. However, because adhesive resins themselves have different combustion characteristics (such as the fire spread and generating manner of fumes), an adhesive that matches with a reference of a desired flame retardancy standard is selected from the selections described above.

In the present invention, water-soluble flame retardant is added to the water solvent adhesive before use. Examples of the water-soluble flame retardant are guanidine salt such as guanidine hydrochloride, guanidine sulfate, guanidine sulfamate which are frequently used for flame retardancy or fireproof processing, and inorganic salt such as ammonium sulfamate, ammonium phosphate, ammonium sulfate, calcium chloride, and magnesium chloride.

If a flame retardant having relatively strong hygroscopicity, such as ammonium phosphate and calcium chloride, is selected from the above-mentioned options, the flame retardant permeates also into the partition member 1 from the adhesive 3, and the partition member 1 is provided with both the flame retardancy and hygroscopicity (moisture permeability). With this arrangement, the heat exchanger element, especially the total heat exchanger element can be imparted with the flame retardancy function is provided and (latent heat) exchanging efficiency is enhanced.

The water-soluble flame retardant can be added to the water solvent adhesive in the following manner. That is, because the flame retardant is water solvent, the water-soluble flame retardant is directly added to the water solvent adhesive, they are stirred well to dissolve the flame retardant into the water solvent of the adhesive. It can be prepared also by preparing aqueous solution of the water-soluble flame retardant and mixing the aqueous solution and the water solvent adhesive. If too much water-soluble flame retardant is added, solvent of the aqueous solution, i.e., adhesive composition is coagulated (salted out) and a deposit is generated in some cases. If a deposit is generated, adhering effect is hindered, and even if a material has adhering effect, the deposit physically hinders the application of the adhesive and thus, caution must be taken.

In the heat exchanger element according to the first embodiment, the partition member 1 made of a liquid absorbing material and the spacing member 2 made of a liquid absorbing material are adhered to each other using the adhesive 3 in which the water-soluble flame retardant is added to the water solvent adhesive. With this arrangement, the flame retardant A permeates and diffuses into the partition member 1 and the spacing member 2 from the adhesive 3, and the flame retardancy function is realized as the entire heat exchanger element. If a material has liquid absorbability, it can be used as a material of the partition member 1 and the spacing member 2 irrespective of the degree of flame retardancy and thus, a heat exchanger element having high flexibility in selecting the material is realized.

Further, in the case of a conventional heat exchanger element manufactured such that water-soluble flame retardant is impregnated into materials of the partition member and the spacing member before the heat exchanger element is processed, a loss that is discarded together with materials at the time of adjusting size during processing step of the heat exchanger element is generated, and the flame retardancy of the heat exchanger element is reduced. However, in the case of the heat exchanger element of the first embodiment, it is possible to contrive such that an adhesive is not applied to a portion of a material that is to be discarded, as a result, it is possible to obtain a heat exchanger element having the same or higher level of flame retardancy using the same amount of flame retardant. At the same time, because less chemical solution is discarded, environmental load caused by production is also reduced, and an environmentally-friendly heat exchanger element can be achieved.

Manufacturing Method of Heat Exchanger Element

Figure 4:
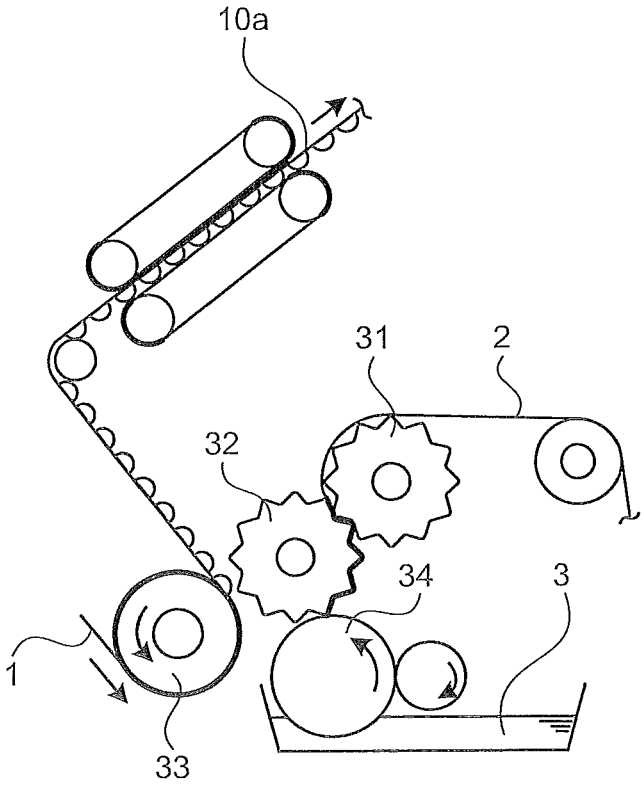
FIG. 4 is a schematic diagram for explaining a method of manufacturing the heat exchanger element according to the first embodiment of the present invention.

A method of manufacturing the heat exchanger element 10 shown in FIG. 1 is explained next. FIG. 4 is an explanatory diagram for explaining the method of manufacturing the heat exchanger element 10 and is a schematic diagram for explaining how a corrugating operation is performed. First, the sheet-like partition member 1 is formed of a liquid absorbing material and the sheet-like spacing member 2 is formed of a liquid absorbing material. Next, the sheet-like partition member 1 and the spacing member 2 is supplied to a corrugating machine that corrugates (forms corrugation on its surface) a single-side corrugated cardboard as shown in FIG. 4. That is, the sheet-like spacing member 2 is formed with mountains (corrugation) by corrugators 31 and 32. A paste (the adhesive 3) is applied to crests of one side of the mountains (corrugation) of the spacing member 2 by a pasting roll 34. Thereafter, the spacing member 2 to which the paste (the adhesive 3) is applied is pasted on the sheet-like partition member 1 that is sent by a press roll 33.

Figure 5:
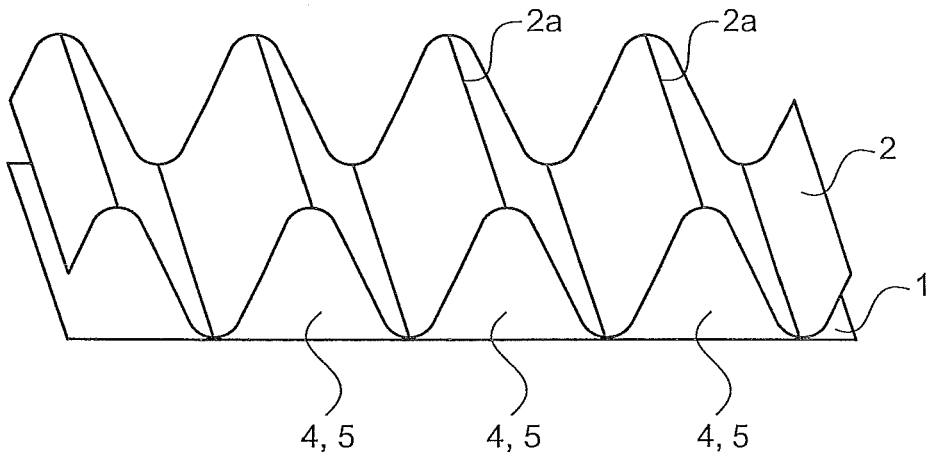
FIG. 5 is another schematic diagram for explaining the method of manufacturing the heat exchanger element according to the first embodiment of the present invention.

Then, the partition member 1 and the spacing member 2 formed with mountains (corrugation) are adhered to each other to form a unit constituent member 10*a* that has one sheet of the partition member 1 and one sheet of the spacing member having mountains (corrugation) as shown in FIG. 5. FIG. 5 is another explanatory diagram for explaining the method of manufacturing the heat exchanger element 10, and it depicts the unit constituent member 10*a*. Regions in the unit constituent member 10*a* between the partition member 1 and the spacing member 2 are the first layer airflow passage 4 and the second layer airflow passage 5 of the heat exchanger element 10.

Next, using a roll coater, the adhesive 3 is applied to crests 2*a* of the mountains (corrugation) of the spacing member 2 of the unit constituent member 10*a* (first unit constituent member 10*a*) on a side that is not adhered to the partition member 1. A new unit constituent member 10*a* (second unit constituent member 10*a*) is superposed on the first unit constituent member 10*a* and they are adhered to each other through the adhesive 3. At that time, the second unit constituent member 10*a* is rotated by 90° in-plane direction of the first partition member 1, and the second unit constituent member 10*a* is superposed on the first unit constituent member 10*a* such that the partition member 1 of the second unit constituent member 10*a* is adhered to the crests 2*a* of the mountains (corrugation) of the first partition member 1. By repeating this step a plurality of times, the heat exchanger element 10 as shown in FIG. 1 is manufactured.

In manufacturing the heat exchanger element, the adhesive 3 is used in two steps, that is, the step of manufacturing the unit constituent member 10*a* and the step of laminating the unit constituent member 10*a*, however, there is no problem if the water solvent adhesive having the water-soluble flame retardant is used in any of the steps, because the unit constituent members are laminated and all of the members and the adhesive having the flame retardant come into contact with each other. Because an amount by which the effect of the flame retardant is exhibited is determined by the flame retardant, it must be noted that the flame retardant of that amount is equal to the application amount of adhesive that can be supplied to the liquid absorbing partition member 1 and the spacing member 2. The adhesive having the water-soluble flame retardant can be used in both of the two steps.

In the method of manufacturing the heat exchanger element according to the first embodiment, the partition member 1 made of a liquid absorbing material and the spacing member 2 made of a liquid absorbing material are adhered to each other using the adhesive 3 in which the water-soluble flame retardant is added to the water solvent adhesive. With this configuration, while the water solvent is dried after the water solvent adhesive 3 adheres, the water-soluble flame retardant permeates liquid-absorbing portions of the partition member 1 and the spacing member 2 from the adhesive 3 and the flame retardant is diffused into the liquid-absorbing portions, and the entire heat exchanger element can be provided with the flame retardancy function.

According to the method of manufacturing the heat exchanger element, a material of the element is provided with the flame retardancy function when the heat exchanger element is manufactured (at the time of adhesion). The total manufacturing time of the heat exchanger element itself is reduced, energy required for manufacturing the element is reduced, cost thereof is reduced, and the heat exchanger element can be manufactured easily and inexpensively. If a material has liquid absorbability, it can be used as a material of the heat exchanger element irrespective of the degree of flame retardancy, and flexibility in selecting the material is enhanced.

Further, an effect of flame retardancy when the same amount of flame retardant is used is considered. In the conventional manufacturing method, the water-soluble flame retardant is impregnated in materials of the partition member 1 and the spacing member 2 before the heat exchanger element is processed. In this case, a loss that is discarded together with materials at the time of adjusting size during processing step of the heat exchanger element is generated, and the flame retardancy of the heat exchanger element is reduced. In the case of the method of manufacturing the heat exchanger element, however, because it is possible to contrive such that an adhesive is not applied to a portion of a material that is to be discarded, it is possible to manufacture a heat exchanger element having the same or higher level of flame retardancy using the same amount of flame retardant. At the same time, because chemical solution to be discarded is reduced, environmental load caused by production is also reduced, and an environmentally-friendly heat exchanger element can be manufactured.

The method of manufacturing the heat exchanger element of the first embodiment can be applied to any kinds of heat exchanger elements including sensible heat exchanger element, latent heat exchanger element, and total heat exchanger element only if the partition member 1 and the spacing member 2 have liquid absorbability and the adhesive 3 of water solvent type is used.

Example 1

In Example 1, a heat exchanger element according to the first embodiment was manufactured under the following conditions. The partition member 1 was prepared with a specially processed paper sheet made of a liquid absorbing material of about 20 g/m$^2$ basis weight in which cellulose fiber (pulp) was subjected to beating and 200 sec/100 cc or higher Gurley air permeance and air resistance was secured. The spacing member 2 was prepared with a white machine-glazed quality paper of about 40 g/m$^2$ basis weight was used as the liquid absorbing material.

As the adhesive 3 for adhering the partition member 1 and the spacing member 2 to each other, 70% by weight guanidine sulfamate and a small amount of water for adjusting viscosity were added to water-based vinyl acetate resin emulsion adhesive (about 40% was solid) as flame retardant, and this was used. Using these members, a heat exchanger element having a shape shown in FIG. 1 was manufactured as the heat exchanger element according to the Example 1 in accordance with the manufacturing method explained in the first embodiment.

Second Embodiment

Figure 6:
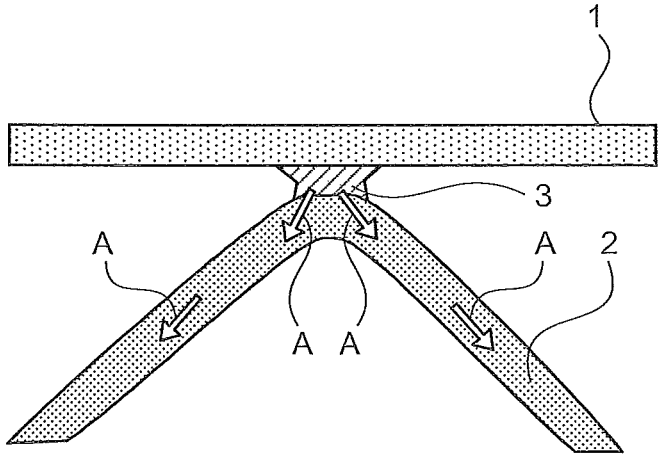
FIG. 6 is an enlarged sectional view of an adhered portion where a partition member and a spacing member are adhered in a heat exchanger element according to a second embodiment of the present invention.

FIG. 6 is an enlarged sectional view of an adhered portion where the partition member 1 and the spacing member 2 are adhered in a heat exchanger element according to a second embodiment. The heat exchanger element of the second embodiment has the same configuration as that of the first embodiment shown in FIG. 1.

In the second embodiment, the partition member 1 is made of a non-porous and liquid non-absorbing material. When the partition member 1 is made of a non-porous and liquid non-absorbing material, it can be used no matter whether it has moisture permeability. The term non-porous means that it has 200 sec/100 cc or higher Gurley air permeance and air resistance. Examples of members made of a non-porous and non-hygroscopicity material are resin films and metal sheets. A member made of a liquid absorbing material and both of whose front and back surfaces are coated with a liquid non-absorbing material (e.g., a paper sheet with resin or metal foil is laminated on both surfaces thereof) has substantially liquid non-absorbability to an adhesive, such a material can be considered as being a liquid non-absorbing material.

The spacing member 2 is made of a material having liquid absorbability like the first embodiment. A water-based adhesive in which water-soluble flame retardant is dissolved is used as the adhesive 3 like the first embodiment. The method of manufacturing the heat exchanger element is the same as that of the first embodiment.

In the heat exchanger element according to the second embodiment, because the partition member 1 is made of a non-porous and liquid non-absorbing material, flame retardant added to the adhesive 3 cannot permeate into the partition member 1. However, because the spacing member 2 has liquid absorbability, the spacing member 2 can permeate and diffuse into the spacing member 2 of the flame retardant added to the adhesive 3, and it is possible to obtain almost the same effect as that of a case that a flame-retardant material is used for the spacing member as in the conventional heat exchanger element. If a material has liquid absorbability, it can be used as a material of the spacing member 2 irrespective of the degree of the flame retardancy and thus, a heat exchanger element having high flexibility in selecting the material is realized.

Even when only the spacing member 2 has flame retardancy, if the heat exchanger element is of transverse type as shown in FIG. 1, because many partition members 1 and spacing members 2 are laminated on one another, even when the partition members 1 are made of a flame non-retardant material, upper and lower sides of the partition member 1 are sandwiched between the spacing members 2 made of a flame-retardant material. With this arrangement, the heat exchanger element can exhibit flame retardancy as a whole. If the partition member 1 is made of a liquid non-absorbing, non-porous and flame-retardant material, the entire heat exchanger element can exhibit more excellent flame retardancy.

If the partition member 1 is of non-porous and has liquid non-absorbability and the spacing member 2 has liquid absorbability and of the adhesive 3 water solvent type is used, the heat exchanger element according to the second embodiment can also be applied to any of sensible heat exchanger element, latent heat exchanger element and total heat exchanger element.

Example 2

In Example 2, the heat exchanger element according to the second embodiment was manufactured under the following conditions. A non-porous film made of polyurethane (PUR)-based resin including oxyethylene group and unwoven cloth (about 20 g/m$^2$ basis weight) made of a pulp material were thermocompression bonded to form a sheet, and the sheet was used as the partition member 1. A white machine-glazed quality paper of about 40 g/m$^2$ basis weight that was the same as that of the Example 1 was used as the spacing member 2.

As the adhesive 3 for adhering the partition member 1 and the spacing member 2 to each other, 90% by weight guanidine sulfamate and a small amount of water for adjusting viscosity were added to ethylene-vinyl acetate copolymer resin emulsion adhesive (about 55% was solid) as water-soluble flame retardant, and this was used. Using these members, a heat exchanger element having a shape shown in FIG. 1 was manufactured as the heat exchanger element according to the Example 2 in accordance with the manufacturing method explained in the first embodiment.

Example 3

In Example 3, the heat exchanger element according to the second embodiment was manufactured under the following conditions. Unwoven cloth using polyethylene terephthalate-based resin was adhered to a film extruded from polyester-based thermoplastic resin (material corresponding to the fire-proof class 1 subjected to flame retardancy processing) with thickness of 20 micrometers to 30 micrometers, and this was used as the partition member 1. As the spacing member 2, the same white machine-glazed quality paper of about 40 g/m$^2$ basis weight as that of the Example 1 was used.

As the adhesive 3 for adhering the partition member 1 and the spacing member 2 to each other, 90% by weight guanidine sulfamate and a small amount of water for adjusting viscosity were added to ethylene-vinyl acetate copolymer resin emulsion adhesive (about 55% was solid) as water-soluble flame retardant like the Example 1, and this was used. Using these members, a heat exchanger element having a shape shown in FIG. 1 was manufactured as the heat exchanger element according to the Example 3 in accordance with the manufacturing method explained in the first embodiment.

Third Embodiment

Figure 7:
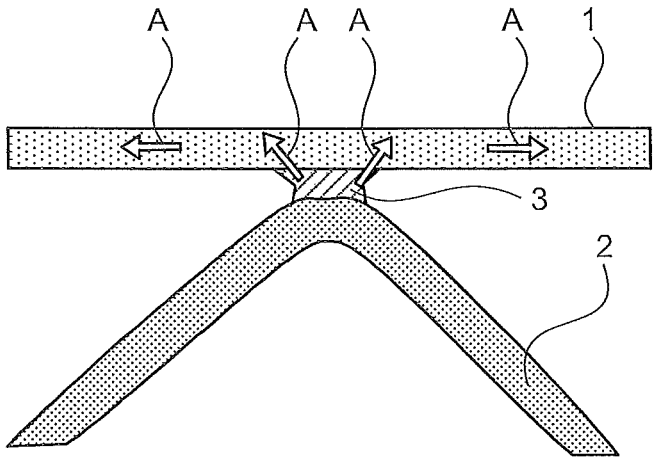
FIG. 7 is an enlarged sectional view of an adhered portion where a partition member and a spacing member are adhered in a heat exchanger element according to a third embodiment of the present invention.
Figure 8:
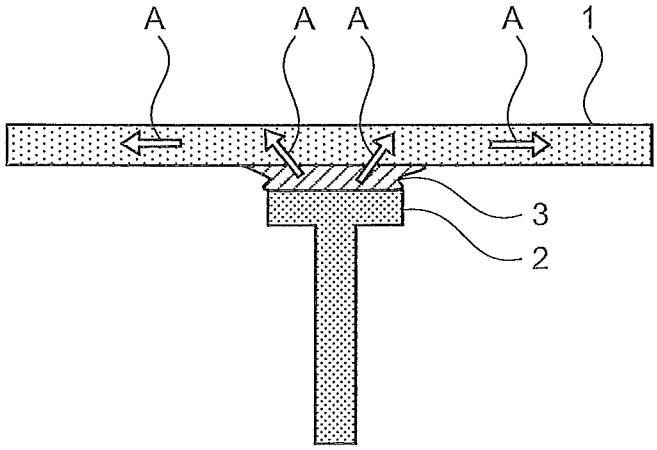
FIG. 8 is an enlarged sectional view of an adhered portion where a partition member and a spacing member are adhered in a variant of the heat exchanger element according to the third embodiment of the present invention.

FIG. 7 is an enlarged sectional view of an adhered portion where the partition member 1 and the spacing member 2 are adhered in a heat exchanger element according to a third embodiment. The heat exchanger element of the third embodiment shown in FIG. 7 has the same configuration as that of the first embodiment shown in FIG. 1. FIG. 8 is an enlarged sectional view of an adhered portion between the partition member 1 and the spacing member 2 in another heat exchanger element according to the third embodiment. Another heat exchanger element of the third embodiment shown in FIG. 8 has the same configuration as that of the first embodiment shown in FIG. 2.

In the third embodiment, the partition member 1 is made of the same liquid absorbing material as that of the partition member of the first embodiment. The spacing member 2 is made of the same non-porous liquid absorbing material as the partition member of the second embodiment. A water-soluble flame retardant is dissolved in a water-based adhesive and this is used as the adhesive 3 like in the first embodiment. The method of manufacturing the element is the same as that of the first embodiment.

In the heat exchanger element according to the third embodiment, because the spacing member 2 is made of a non-porous and liquid non-absorbing material unlike the second embodiment, flame retardant added to the adhesive 3 does not permeate into the spacing member 2. However, because the partition member 1 has liquid absorbability, flame retardant added to the adhesive 3 can permeate and diffuse into the partition member 1, and it is possible to obtain almost the same effect as that of the conventional heat exchanger element in which the partition member is made of a flame-retardant material. If a material has liquid absorbability, it can be used as a material of the partition member 1 irrespective of the degree of the flame retardancy and thus, a heat exchanger element having high flexibility in selecting the material is realized.

However, when the corrugated structure as shown in FIG. 1 is employed for the partition member 1, because the spacing member 2 has a greater area than the partition member 1, even if only the partition member 1 is made of a flame-retardant material, the flame retardancy function as the entire heat exchanger element is not sufficient in many cases. However, such a problem can be solved by using a material having liquid non-absorbability and flame retardancy function (resin or metal subjected to the flame retardancy processing) for the spacing member 2.

As shown in FIG. 2, when the heat exchanger element has such a configuration that the spacing member 2 having a plurality of plate pieces (ribs) hold the partition member 1, the number of ribs is reduced or the rib shape is contrived to reduce the using amount of the spacing member 2. With this configuration, even if a material having a flame retardancy function is not used for the spacing member 2, because the partition member 1 is made flame-retardant by the flame retardant that permeates from the adhesive 3, a sufficient flame retardancy function can be obtained as the entire heat exchanger element.

The heat exchanger element according to the third embodiment can be applied to any of the sensible heat exchanger element, the latent heat exchanger element, and the total heat exchanger element only if the partition member 1 has liquid absorbability and the spacing member 2 is non-porous and has liquid non-absorbability and the adhesive 3 of water solvent type is used.

Example 4

In Example 4, the heat exchanger element according to the third embodiment was manufactured under the following conditions. The partition member 1 was prepared with a specially processed paper sheet made of a liquid absorbing material of about 20 g/m$^2$ basis weight in which cellulose fiber (pulp) that was the same as that of the Example 1 was subjected to beating and 200 sec/100 cc or higher Gurley air permeance and air resistance was secured. A corrugated polyethylene terephthalate resin sheet that was made flame-retardant (about 60 μm thickness) was used as the spacing member 2.

A flame retardant was added to a water-based acryl resin pressure sensitive adhesive and this was used as the adhesive 3 that adheres the partition member 1 and the spacing member 2 to each other. As in manufacturing the heat exchanger element, a corrugating machine was not used for manufacturing the unit constituent member, a corrugated spacing member was inserted into a roll coater, an adhesive was applied to crests, the partition member 1 was adhered on the crests and thus, the unit constituent member was manufactured. Other than this, the heat exchanger element having the shape shown in FIG. 1 was manufactured as the heat exchanger element of the Example 4 in accordance with the manufacturing method explained in the first embodiment.

Example 5

In Example 5, the heat exchanger element according to the third embodiment was manufactured under the following conditions. The partition member 1 was prepared with a specially processed paper sheet made of a liquid absorbing material of about 20 g/m$^2$ basis weight in which cellulose fiber (pulp) that was the same as that of the Example 1 was subjected to beating and 200 sec/100 cc or higher Gurley air permeance and air resistance was secured. A plastic corrugated cardboard (raw material was polypropylene resin) was cut into a thin and long shape, it was processed into a thin and long rod such that its cross section was formed into I-shape, and this was used as the spacing member 2.

A flame retardant was added to a water-based acryl resin pressure sensitive adhesive and this was used as the adhesive 3 that adheres the partition member 1 and the spacing member 2 to each other. In manufacturing the heat exchanger element, an adhesive was applied to an end surface of the spacing member 2 in its longitudinal direction, the partition member 1 was pasted on the end surface, and the unit constituent member was pasted thereon. A heat exchanger element having a shape shown in FIG. 2 was manufactured as the heat exchanger element of the Example 5.

Flame retardancy effects of the heat exchanger elements of the Examples 1 to 5 were evaluated. For the heat exchanger elements of the Examples 1 to 5, three laminated layers of the unit constituent members were regarded as one element, flame retardancy test (45° Meker burner method) prescribed in JIS A1322 "Testing Method for Incombustibility of Thin Materials for Buildings" was carried out, the size (area) of a fire spread portion was measured. Results are shown in Table. Most of the heat exchanger elements of the Examples 1 to 5 had the fireproof class 2, and it could be verified that the flame retardancy effect of the present invention was exhibited.

| | Material of partition member | Material of spacing member | Size of fire spread portion [cm] |
|---|---|---|---|
| Example 1 | Specially processed paper sheet | Machine-glazed quality paper | 8.9 |
| Example 2 | Polyurethane non-porous film | Machine-glazed quality paper | 10.2 |
| Example 3 | Polyester-based non-porous film | Machine-glazed quality paper | 5.5 |
| Example 4 | Specially processed paper sheet | PET resin | 4.2 |
| Example 5 | Specially processed paper sheet | PP resin | 9.5 |

Fourth Embodiment

Figure 9:
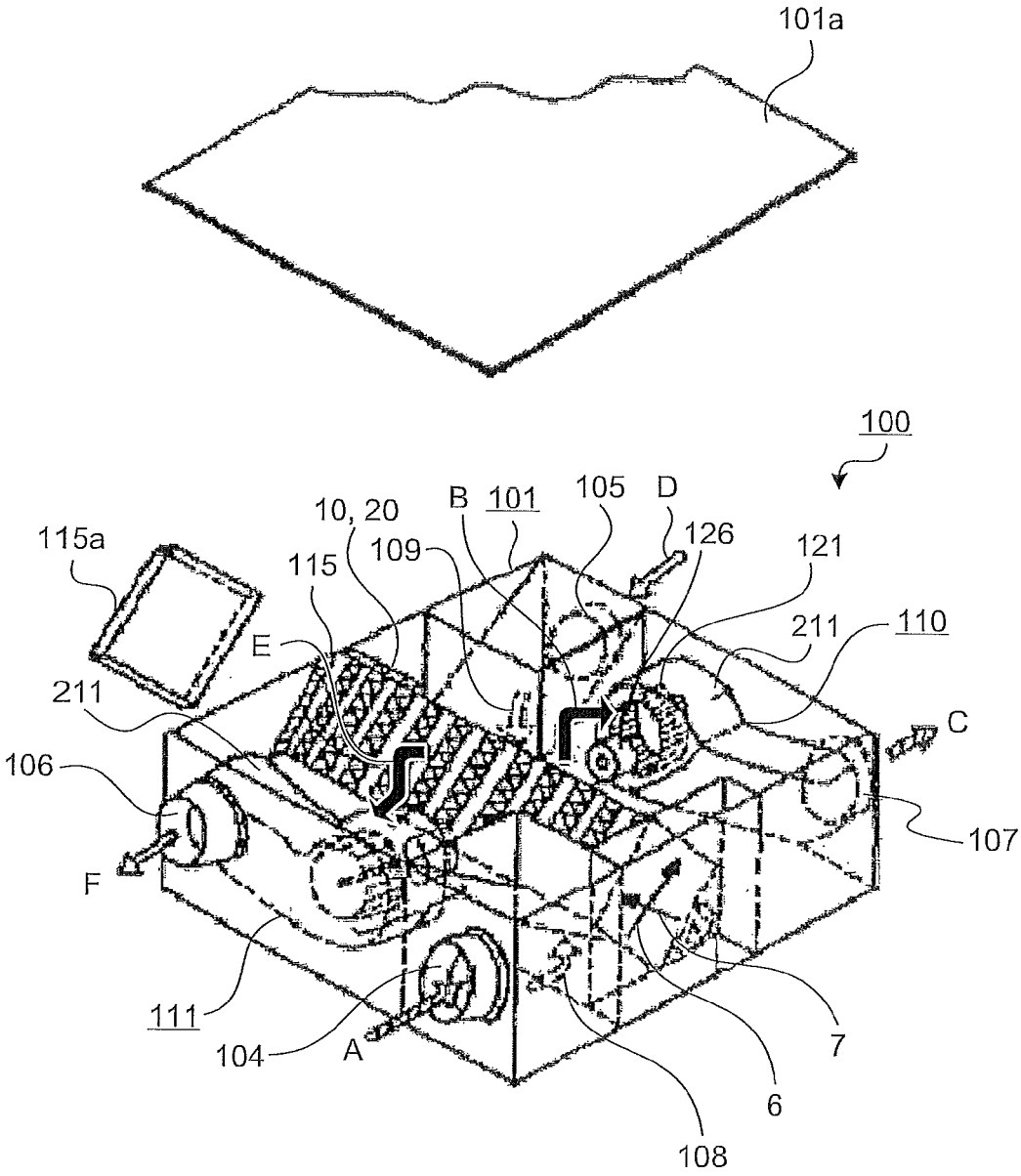
FIG. 9 is a perspective view of a heat exchanger in which the heat exchanger element according to the present invention is incorporated in a state where a top cover of the heat exchanger has been removed.

In a fourth embodiment, a heat exchanger having the heat exchanger element according to the present invention will be explained. FIG. 9 is a perspective view of an air conditioning heat exchanger 100 in which the heat exchanger element 10 or 20 can be incorporated, and a top cover 101*a* of the heat exchanger 100 has been removed to show internal parts of the heat exchanger 100. The heat exchanger 100 according to the fourth embodiment is accommodated in a rectangular parallelepiped chassis 101. An indoor inlet opening 104 and an indoor outlet opening 106 are provided in one of opposed side surfaces of the chassis 101, and an outdoor inlet opening 105 an outdoor outlet opening 107 are provided in the other side surface of the chassis 101. The inlet opening 104 and the outlet opening 107 is in communication with each other through a discharge passage 108, and the inlet opening 105 and the outlet opening 106 are in communication with each other through a suction passage 109.

A blower 110 having an impeller 121, a motor 126 and a casing 211 is disposed in the discharge passage 108, and indoor air is discharged outside of the room from the outlet opening 107. A blower 111 having the impeller 121, the motor 126 and the casing 211 is disposed in the suction passage 109, and outdoor air is supplied into the room from the outlet opening 106.

The heat exchanger element 10 or 20 is inserted from an insertion opening 115 formed in the other side surface of the chassis 101, and the heat exchanger element is disposed at an intermediate portion between the discharge air flow passage 108 and the suction passage 109 such that the first layer air passage 4 (see FIG. 1) is brought into communication with the discharge passage 108 and the second layer air passage 5 (see FIG. 1) is brought into communication with the suction passage. After the heat exchanger element 10 or 20 is inserted, the insertion opening 115 is closed with a detachable lid 115*a*.

If the blowers 110 and 111 shown in FIG. 9 are operated, indoor air is sucked from the indoor inlet opening 104 through a duct (not shown) as shown with an arrow A, the air passes through the discharge air flow passage 108 and through the first layer airflow passage (the first layer airflow passage 4 shown in FIG. 1 as shown by an arrow 6 in FIG. 9 of the heat exchanger element 10 or 20, and the air is sucked by the discharge blower 110 as shown with an arrow B, and the air is discharged outside the room from the outdoor outlet opening 107 as shown with an arrow C.

The air is sucked from the indoor inlet opening 105 through a duct (not shown) as shown with an arrow D, the air flows through the suction passage 109 and through the second layer airflow passage (the second layer airflow passage 5 shown in FIG. 1) as shown by an arrow 7 in FIG. 9 of the heat exchanger element 10 or 20, and the air is sucked by the suction blower 111 as shown with an arrow E, the air is sent out from the indoor outlet opening 106 as shown with an arrow F, and the air is supplied into the room through a duct (not shown). At that time, in the heat exchanger element 10 or 20, the heat is exchanged between discharge air flow B (first air 6: see FIGS. 1 and 9) and supply air flow E (second air 7: see FIGS. 1 and 9) through the partition member 1 (total heat exchange for exchanging latent heat and sensible heat at the same time is carried out when the partition member 1 has moisture permeability, and latent heat is exchanged when the partition member 1 does not have moisture permeability), waste heat is collected and an air conditioning load is reduced.

Although heat exchange of air was exemplified in the first to fourth embodiments, the subject of heat exchange in the present invention is not limited to air. Although it has been exemplified that the first layer air passage 4 and the second layer air passage 5 intersect with each other at right angles in the first to fourth embodiments, these passages do not need to intersect with each other at right angles.

INDUSTRIAL APPLICABILITY

As described above, the heat exchanger element according to the present invention can be used in various fields such as a heat exchanging ventilation that provides ventilation in a building or in a moving body such as an automobile and a train.

The invention claimed is:

1. A heat exchanger element comprising:

partition members made of a material that is liquid absorbing and not flame retardant, which form first gas passages configured to flow a first gas and second gas passages configured to flow a second gas, the partition members operative to partition the first gas passages and the second gas passages;

spacing members made of a material that is liquid absorbing and not flame retardant, which form the first gas passages and the second gas passages together with the partition members and that maintain a gap between the partition members; and a water solvent adhesive that adheres the partition members and the spacing members with each other, a water-soluble flame retardant being dissolved into the water-solvent adhesive, the water-soluble flame retardant permeating and diffusing into the partition members and the spacing members from the water solvent adhesive and providing the partition members and the spacing members with flame retardancy at the time of adhesion.

2. The heat exchanger element according to claim 1, wherein a direction of the first gas passages and a direction of the second gas passages are different from each other.

3. The heat exchanger element according to claim 2, wherein the direction of the first gas passages and the direction of the second gas passages are perpendicular to each other.

4. The heat exchanger element according to claim 1, wherein the first layer gas passages and the second layer gas passages are provided in multilayer.

5. The heat exchanger element according to claim 1, wherein the partition member has hygroscopicity.

6. The heat exchanger element according to claim 1, wherein the water-soluble flame retardant has hygroscopicity.

7. A heat exchanger that exchanges heat between first gas and second gas, including a heat exchanger element, the heat exchanger element comprising:

partition members made of a material that is liquid absorbing and not flame retardant, which form first gas passages configured to flow a first gas and second gas passages configured to flow a second gas, the partition members operative to partition the first gas passages and the second gas passages;

spacing members made of a material that is liquid absorbing and not flame retardant, which form the first gas passages and the second gas passages together with the partition members and that maintain a gap between the partition members; and a water solvent adhesive that adheres the partition members and the spacing members with each other, a water-soluble flame retardant being dissolved into the water-solvent adhesive, the water-soluble flame retardant permeating and diffusing into the partition members and the spacing members from the water solvent adhesive and providing the partition members and the spacing members with flame retardancy at the time of adhesion.

* * * * *